US006112436A

United States Patent [19]

Quellais

[11] Patent Number: 6,112,436

[45] **Date of Patent: *Sep. 5, 2000**

[54] SNOWSHOE WITH ELASTICALLY SUSPENDED FOOT SUPPORT PIECE

[75] Inventor: Jacques Quellais, Epagny, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/089,379

[22] Filed: Jun. 3, 1998

[30] Foreign Application Priority Data

Jun. 4, 1997 [FR] France ..... 9707140

[51] Int. Cl.[7] ..... A43B 5/04

[52] U.S. Cl. ..... 36/124; 36/125

[58] Field of Search ..... 36/122–125, 116

[56] References Cited

U.S. PATENT DOCUMENTS

| | | |
|---|---|---|
| 4,720,927 | 1/1988 | Abegg . |
| 5,440,827 | 8/1995 | Klebahn et al. . |
| 5,540,002 | 7/1996 | Liautaud . |
| 5,542,197 | 8/1996 | Vincent . |
| 5,718,068 | 2/1998 | Sawyer et al. . |

FOREIGN PATENT DOCUMENTS

| | | |
|---|---|---|
| 634114 | 1/1962 | Canada . |
| 1142974 | 3/1983 | Canada . |
| 0613703 | 9/1994 | European Pat. Off. . |
| 2409066 | 7/1979 | France . |
| 2255406 | 5/1974 | Germany . |
| 0961729 | 9/1982 | U.S.S.R. . |

*Primary Examiner*—Ted Kavanaugh
*Attorney, Agent, or Firm*—Greenblum & Bernstein, P.L.C.

[57] ABSTRACT

A snowshoe that includes a support piece for the user's foot which extends transversely within the frame of the snowshoe and which allows the foot to pivot in order to ease walking. The support piece is elastically suspended within the frame by attachment elements connecting it to the sides of the frame. The support piece can thus be lowered in its entirety depending on the direction and/or the value of the weight to which it is subjected transversely with respect to the snowshoe while remaining substantially horizontal. The snowshoe as disclosed is particularly intended for traversing along a sloped terrain.

29 Claims, 3 Drawing Sheets

1
41
40'
40
33
40'
41
11
11'
14
14

1
41
40
33
41
40'
11
11'
40'

1
30
3
30
11
11'
4
14
14

1
46
45
44'
43
44
44'
45
46
11
11'
14
14

1
46
45
44'
43
44
44'
46
45
11'
15
11
25
14
14
26

SNOWSHOE WITH ELASTICALLY SUSPENDED FOOT SUPPORT PIECE

BACKGROUND OF THE INVENTION

1. Field of the Invention

The present invention relates to a snowshoe and, more specifically, to an improvement intended to at least partially reset the natural transverse balance position of the user's foot, with respect to the frame of the snowshoe when advancing occurs on sloped terrain.

2. Description of Background and Material Information

A snowshoe having the aforementioned type of improvement is described in European Patent application No. 613 703. According to this document, the snowshoe has, in a known manner, a screen encased in a frame, defining the carrying surface, and a support piece extending within the frame of the snowshoe, and on which is attached the boot with which the user's foot is provided. This support piece enables the foot to pivot in order to ease walking, and in this improved version, is adapted to allow at least the partial resetting of the natural transverse balance position of the foot with respect to the frame of the snowshoe when the latter is laterally inclined. More specifically, the support piece is journalled about two axes located on a support attached to the screen. These axes are oriented in a substantially perpendicular manner with respect to each other, one defining the vertical pivoting direction of the support piece, and the other, the lateral pivoting direction of the support with respect to the longitudinal axis of the frame of the snowshoe, using two aligned pivoting axes. As described and taught, the assembly constituted by the support piece and the support is thereby capable of pivoting laterally with very great ease since the support acts like a balance beam that remains balanced on its pivoting axes essentially when the weight applied on it vertically is equally distributed in the direction transverse to the snowshoe, i.e., perpendicular to the pivoting axes. Conversely, in the case where the weight exerted by the foot is greater on one side of the snowshoe, which happens inevitably as soon as advancing occurs on a sloped terrain, the "support piece-support" assembly immediately tilts on the pivoting axes of the support by lowering itself on the heavier side and raising itself on the other. Consequently, the "support piece-support" assembly cannot, of itself, bring the user's foot back to its natural transverse balance position, i.e., into an almost horizontal plane. Indeed, in the absence of deliberate physical effort and/or blocking of the journal of the foot by the user, the foot tilts towards the heavier side. In fact, this pivoting potential provided to the support piece by the support only offers a random solution to the issue of the transverse retention of the foot on the snowshoes when advancing occurs on sloped terrain. Also, given that the support piece with its support tilts laterally at the slightest lateral variation of the weight applied on it vertically, it follows that even the simplest support engagement of the user's foot on the snowshoe is capable of making it tilt if it is not perfectly perpendicular to its pivoting axes. This is what happens almost always when walking with snowshoes, even on a horizontal terrain; indeed, advancing with snowshoes imposes a particular walk on the user through which he/she alternately takes support on one foot and then on the other while keeping the feet separated from one another to avoid hooking the frames of the snowshoes together. The result of such walking is that the weight exerted by the foot on the support piece is naturally always greater on the inside and therefore the support piece tilts by lowering itself on this same side and by raising itself on the other side until the support rests on the surface of the ground.

Therefore, such a mounting of the support piece is very restrictive for the user since at every step, and regardless of the slope of the terrain, the foot on which the user presses down tends to tilt laterally and abruptly, since the support functions like a balance beam. Consequently, the user is always at the risk of being laterally unbalanced, even on a horizontal terrain, especially since there are no means allowing for a possible dampening of the lateral tilting movement of the support piece and its support. Also, the absence of a means capable of laterally maintaining the support piece in a plane substantially parallel to that of the carrying surface of the snowshoe makes it difficult to put the snowshoe on, as the user must present the foot slantwise to the side where the support piece tilts naturally when it is not weighted down.

Furthermore, given the fact that the support is positioned, with respect to the screen of the snowshoe, at a constant height by its aligned pivoting axes, the adherence and/or grip of the snowshoe on the ground, especially on sloped terrain, can be problematic; indeed, only that edge of the support which is on the side where the latter was lowered is susceptible of being projected with respect to the plane of the carrying surface of the snowshoe, and this, no matter what the laterally applied weight is, whether from the sloped terrain or the user's weight.

SUMMARY OF THE INVENTION

An object of the invention is to provide an improvement for remedying the aforementioned different drawbacks, the invention having the following objectives:

- allowing at least the partial resetting of the natural transverse balance position of the user's foot with respect to the frame of the snowshoe on sloped terrain by the lateral lowering of the support piece in its entirety and on the side directed upwardly;
- varying the height position of the support piece depending on the user's weight especially when the latter is heavy so that the foot support piece can come closer to the plane of the carrying surface of the snowshoe which reinforces the levitation polygon thereof;
- ensuring the transverse retention of the support piece in a plane substantially parallel to that of the carrying surface of the snowshoe when it is not weighted down;
- ensuring the transverse retention of the support piece in a fixed position with respect to the frame of the snowshoe so that the user's foot is maintained, during its pivoting, in a preferred and constant direction by the attaching means;
- improving the grip of the support points of the snowshoe by causing the relative displacement of such support points with respect to the surface of the ground, by way of scraping, each time the user takes support on the support piece;
- dampening the support engagement of the user's foot on the support piece to allow flexible walking without any lateral imbalance.

To obtain these objectives, the snowshoe, according to the invention, has a support piece for the user's foot extending within the frame of the snowshoe and enables the pivoting of the foot to ease walking whilst allowing at least the partial resetting of the natural transverse balance position of the foot with respect to the frame of the snowshoe when advancing occurs on sloped terrain. The support piece is elastically suspended within the frame by attaching elements connecting it to the sides of the frame. These attaching elements are advantageously fixed into position with respect to the frame of the snowshoe so that the pivoting of the user's foot in the walking direction occurs in a preferred, relatively constant direction. According to these arrangements, when the snowshoe is placed on a horizontal terrain, and the weight applied by the foot is centered on the support piece, the weight is borne substantially by all the attaching elements connecting it from one side of the snowshoe to the other.

However, when the snowshoe is placed on a sloped terrain, it is the attaching elements directed downwardly which support, first of all, the main weight applied to the support piece. Secondly, by reaction of the pressure on these attaching elements directed downwardly, the support piece lowers itself laterally and in its entirety towards the surface of the ground by pulling on the attaching directed upwardly, and this occurs until the weight applied is distributed substantially equally over all the attaching elements, i.e., perpendicular to the support piece.

The support piece therefore remains suspended substantially horizontally at a certain height from the surface of the ground, depending on the direction and/or the value of the weight to which it is subjected, and depending on the elastic resistance transmitted by all of the attaching elements. From this functioning provided by the elastic suspension of the support piece, the result is that the latter is automatically reset into an approximately horizontal position close to the natural transverse balance position of the user's foot and, in any case, into a position close to the horizontal.

Obviously, the support piece can be advantageously equipped with gripping elements, such as clamps/staples, snow blades, etc., which, when directed towards the side of the snowshoe surface coming into contact with the snow, improve the adherence and anchoring of the snowshoe onto frozen terrain in particular.

According to another characteristic, the frame of the snowshoe is elastically deformable in the direction transverse to the snowshoe at least at the places where the attaching elements of the snowshoe are fixed. Therefore, when the user presses down on the support piece, the latter is lowered by a certain value, as previously disclosed, by pulling down on the attaching elements means, which in turn pull at their binding point on the frame of the snowshoe which deforms itself elastically in the direction/closer to the support piece. Consequently, the support points of the snowshoe, which are affixed to the frame, are displaced relative to the surface of the ground by cutting it in a scraping motion, which favors their penetration and thereby their grip, especially on frozen or crusted snow.

BRIEF DESCRIPTION OF THE DRAWINGS

Other characteristics of the invention will emerge from the following detailed description in reference to the annexed schematic drawings showing, by way of example, several possible embodiments, and wherein.

DETAILED DESCRIPTION OF THE INVENTION

Figure 1:
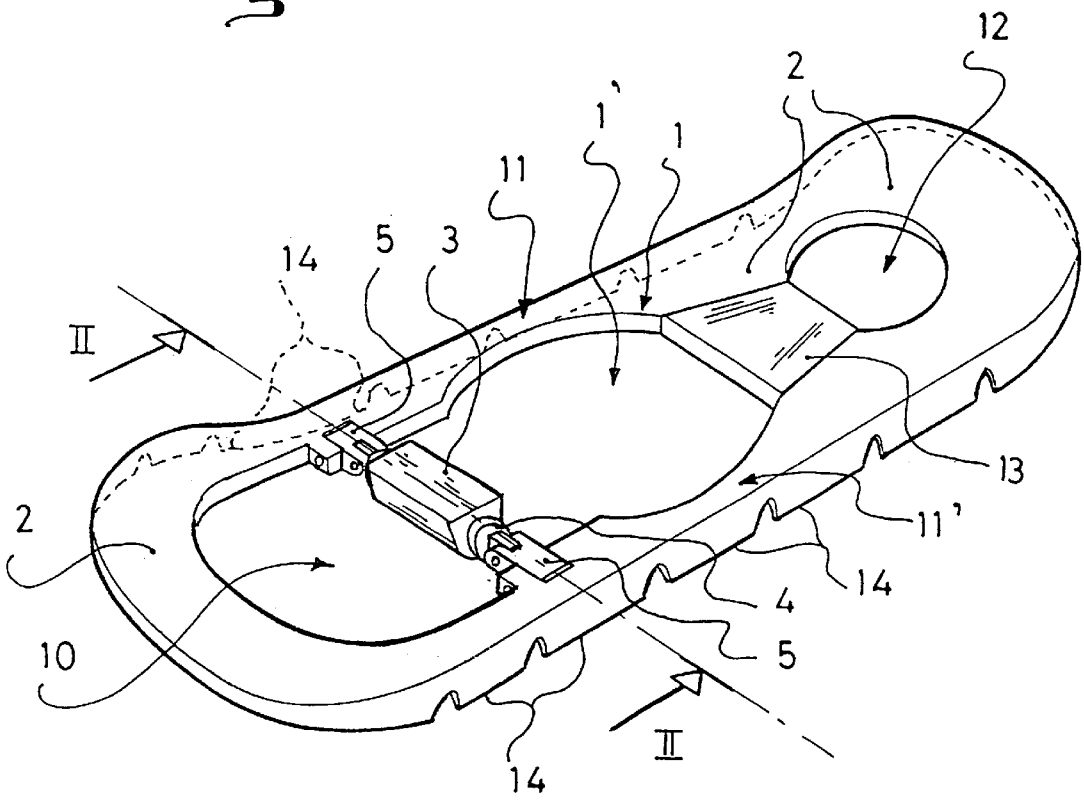
FIG. 1 shows, in a perspective view, a snowshoe with a support piece according to the invention.
Figure 2:
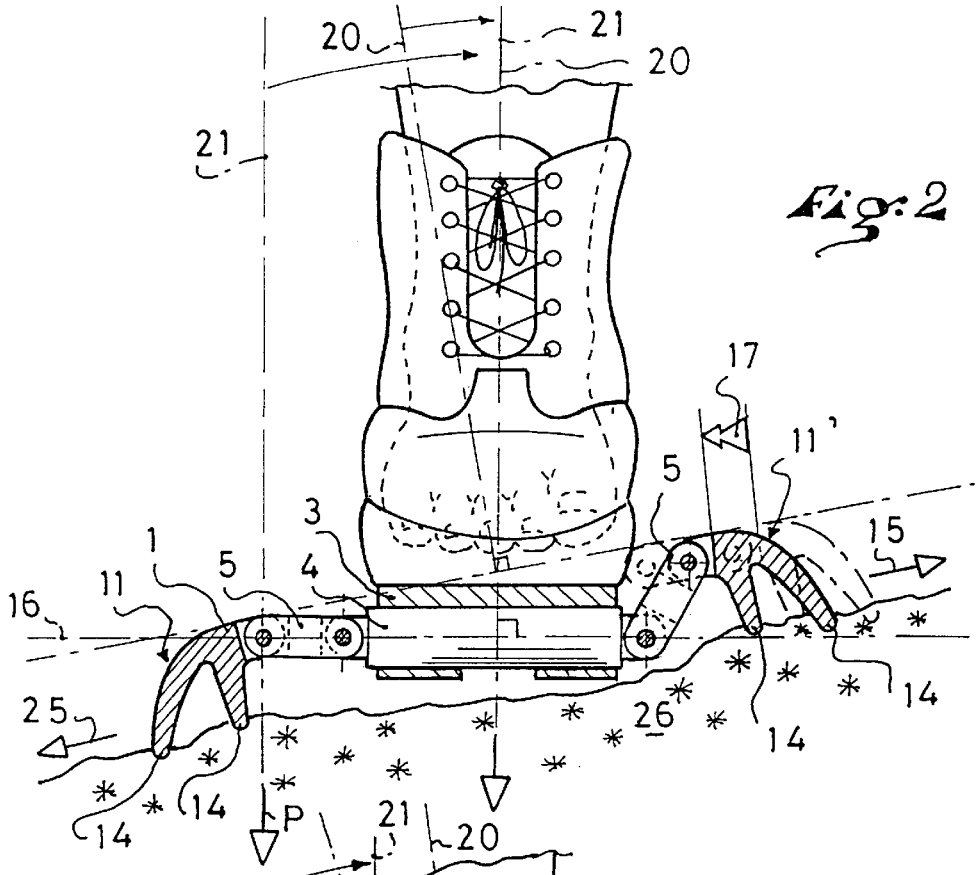
FIGS. 2 and 3 show the snowshoe of FIG. 1, in a cross-sectional view along the line II—II of FIG. 1, respectively on a terrain with a slight slope and on a terrain with a strong slope.
Figure 3:
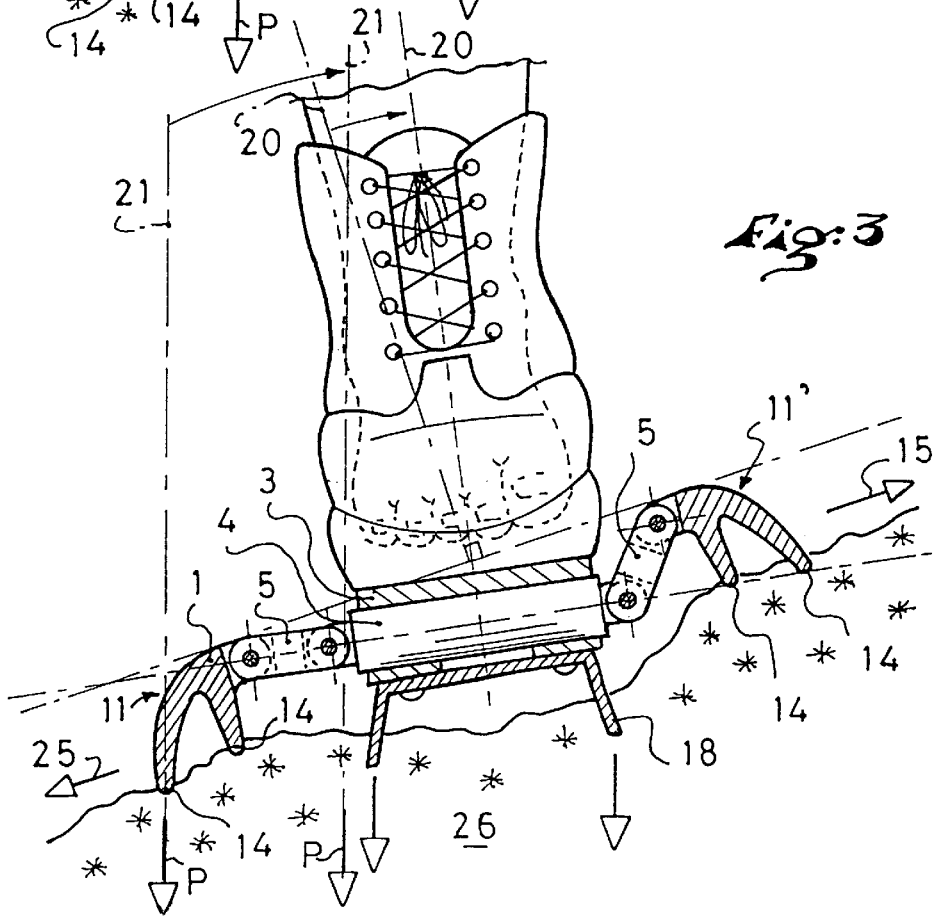

The snowshoe in FIG. 1 has a frame 1 with support zones 2, constituting the screen and determining the carrying surface, and a support piece 3 which, adapted to be equipped with bindings (not shown) for the boot, extends within the frame. The support piece 3 is mounted to pivot in the walking direction and is provided to be capable of resetting, at least partially, the natural transverse balance position of the foot with respect to the frame 1 of the snowshoe, especially when the latter is resting on a sloped terrain. To this end, and according to this embodiment, also shown in FIGS. 2 and 3, the support piece 3 is, on the one hand, rotational along a cylindrical axis 4, and on the other hand, elastically suspended within the frame 1 by connecting rods or linkages 5 constituting the attaching elements connecting it to the sides 11, 11' thereof. Each of the connecting members 5 in FIGS. 1–3 are double-hinged transversely extending members, one hinged connection at the support piece and another hinged connection at the sides 11, 11' of the frame. The frame which is provided to be elastically deformable in a direction transverse to the snowshoe. More specifically, as seen in FIG. 1, the frame 1 is largely cut out, from its central part 1' of the front 10, where the support piece 3 which receives the front of the boot covering the user's foot is located, to the rear 12 where a flexible element 13 is placed, relatively stretchable, and on which the heel of the boot is able to rest. As such, the frame 1 is made flexible transverse to the snowshoe at least at the fixing points of the attaching elements 5 of the support piece 3 which remains suspended in a plane substantially parallel to that of the carrying surface of the snowshoe when it is not weighted down as shown in FIG. 1. In fact, the support piece 3 is maintained in a stable balance by virtue of the elasticity of the sides 11, 11' of the frame 1 of the snowshoe, which retain the attaching 5 in a constant position by pulling on them. This depends, of course, on whether the weight applied by the user's foot on the support piece 3 is more or less substantial with respect to the elastic resistance offered by the sides 11, 11', of the frame 1 of the snowshoe, the sides bending relatively under the effect of the traction exerted on them by the attaching elements 5 by approaching the support piece 3 which is lowered at the same time towards the ground. As shown, the heavier the user, the more the support piece 3 is lowered and comes closer to the ground, which reinforces the levitation polygon of the snowshoe. The height position of the support piece 3 therefore varies in proportion to the weight of the user. Furthermore, given that the sides 11, 11' of the frame of the snowshoe are displaced substantially towards the support piece 3, it follows that the exterior support points 14 of the snowshoe also are displaced with respect to the ground on which they produce a scraping motion, whereby the support points cut into the ground, such as the snow or ice. As can be seen in FIG. 1, for example, the support points 14 can be manifested by a series of discrete longitudinally arranged gripping edges that are unitary with the frame itself.

The bending of the sides 11, 11' of the frame 1 of the snowshoe is of an amplitude substantially equal on each side 11 and 11' as long as the weight applied on the support piece 3 is centered, i.e., that the weight is distributed substantially equally on all the attaching elements 5. However, when the weight is unequally distributed on the support piece 3, and thereby on the sides 11 and 11' of the frame 1 when the snowshoe is placed on the ground, the total amplitude of the bending of the sides 11, 11' generally stays the same as previously, but is more substantial on the side 11 or 11' which then becomes lighter. This is especially true when the snowshoe is used to advance on sloped terrain as shown in FIGS. 2 and 3. Indeed, in such configurations where the frame 1 of the snowshoe is inclined parallel to the terrain, the vertical line 21 of the weight P initially applied on the support piece 3 diverges relatively with respect to the median perpendicular plane 20 thereof and projects itself more so onto the attaching elements 5 which are located on the downward side 25 of the terrain 26.

The side 11 corresponding to the frame 1 is thereby subjected, by the attaching elements 5 connected thereto, to a strong pressure on the terrain 26 where it is anchored. By support reaction on the support points 14 of the side 11 of the frame, the weight P therefore causes the lowering of the support piece 3 in its entirety on the upward side 15 of the terrain 26, and the downward tilting of the attaching elements 5 located on this side. Consecutively, these attaching elements 5 exert a traction on the side 11' constrained to bend or deflect inwardly along the direction 17 towards the support piece 3, its support points 14 thereby scraping the surface of the ground 26. This functioning of the elastically suspended support piece 3 thus allows at least the partial resetting of the user's foot in its natural transverse balance position, since by lowering itself laterally, the support piece 3 brings the vertical line 21 of the weight P back towards its median perpendicular plane 20. In the case of a flatter terrain, as shown in FIG. 2, the vertical line 21 of the weight P can even align itself on the median perpendicular plane 20 of the support piece 3 which thereby adopts a transverse, almost horizontal, position. Of course, in the case of a highly sloped terrain, as shown in FIG. 3, the vertical line 21 of the weight P is closer to the median perpendicular plane 20 of the support piece 3, but is limited in its tilting by the maximum elastic resistance of the side 11', and by the clearance amplitude conferred to the attaching elements 5. In this embodiment, the fact of elastically suspending the support piece 3 in the frame 1 of the snowshoe nevertheless allows at least the partial resetting of the user's foot in its natural transverse balance position and brings the vertical line 21 of the weight P back towards the middle of the frame 1 of the snowshoe in the direction of the median perpendicular plane 20 of the support piece 3. The grip of the snowshoe is thereby clearly improved and the journal of the user's foot is therefore less biased transversely. The support piece 3 can be equipped with clamps 18 to obtain a more solid anchoring/grip than that furnished only by the support points 14 of the frame 1 of the snowshoe.

Other constructions of the support piece 3 and its attaching elements 5 to obtain its elastic suspension in the frame 1 of the snowshoe are possible. FIGS. 4–8 show such constructions by way of example.

Figure 4:
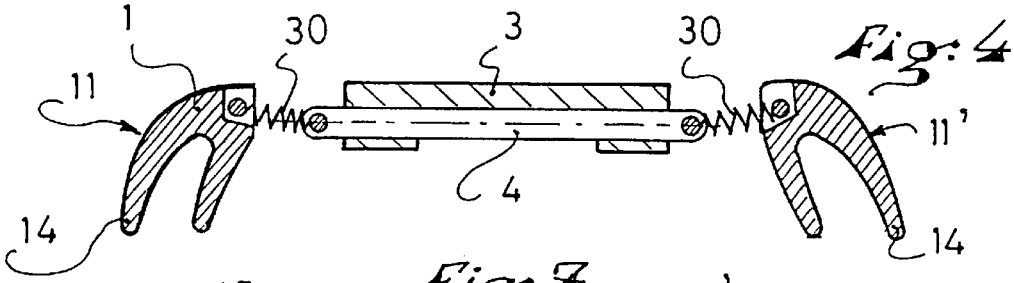

FIG. 4 shows a construction method similar to that of FIGS. 1 and 2 in which the attaching elements 5 previously constituted by connecting rods have merely been replaced by stretchable elastic elements 30. The other component parts are not described again. In this construction method, the natural elasticity of the attaching elements 30 is sufficient for elastically suspending the support piece 3, i.e., the frame 1 of the snowshoe is not necessarily elastically deformable where these attaching elements 30 are fixed on it to allow at least the partial resetting of the natural transverse balance position of the user's foot on sloped terrain.

Figure 5:
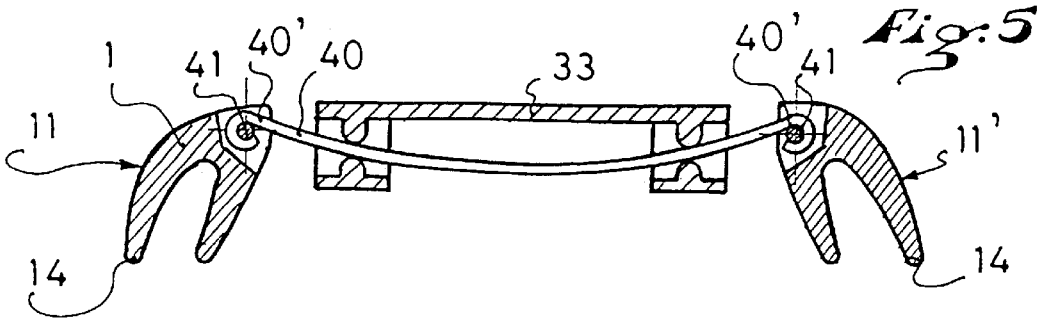
FIGS. 4 through 8 show various embodiments of the support piece and its attaching elements for the frame of the snowshoe, seen along the cross-sectional line 11—11 of FIG. 1, with the exception of FIG. 6 which shows the support piece of FIG. 5 in a top view.
Figure 6:
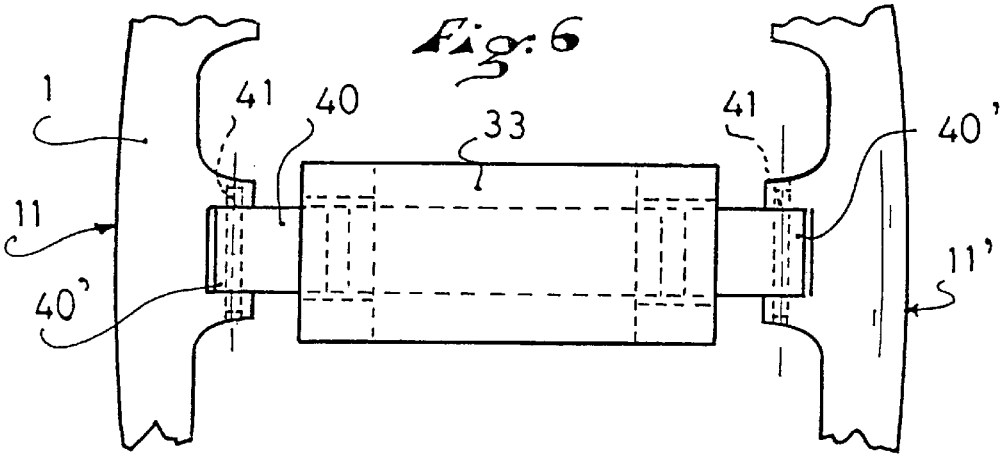

FIGS. 5 and 6 show another embodiment in which the attaching elements are constituted by assembly pins or axles axes 41 which fix the ends 40' of a transverse flexible strap 40 to the frame 1 of the snowshoe. The support piece 33 is mounted to be sliding on the flexible strap 40 and can therefore be displaced transversely to the snowshoe towards one or another of the sides 11, 11' of the frame 1, and pivot in the walking direction by forcing the flexible strap 40 to partially twist. In such a construction, the support piece 33 is thus automatically and elastically returned to its initial position as soon as the user stops forcing it to twist. This return function can be desired to ease stepping forward with the snowshoe, especially by preventing the latter from remaining completely hanging on the side of the heel of the user's foot. Obviously, the support piece 33 can also be mounted rotationally with respect to the flexible strap 40; in this case, outwardly cylindrical spacers, which are mounted to be sliding on the flexible strap 40 and on which the support piece 33 is rotative, are used.

Figure 7:
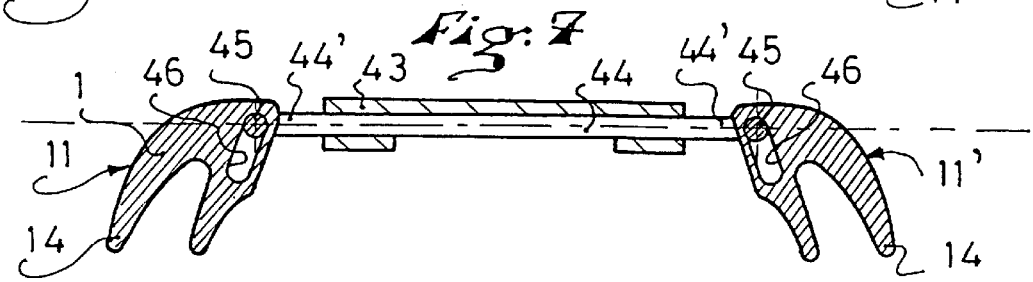
Figure 8:
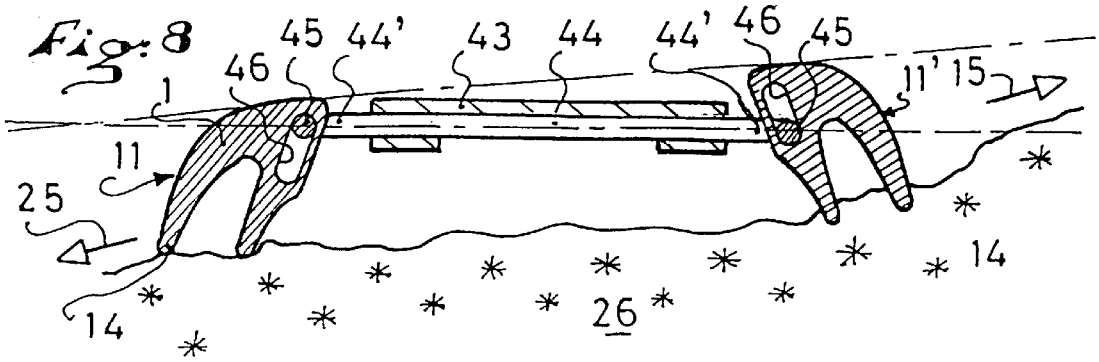

In the embodiment shown in FIGS. 7 and 8, the support piece 43 is mounted on a rods or axles 44, transverse to the snowshoe, whose ends 44' are connected to the frame 1 of the snowshoe by attaching elements 45 constituted of assembly pins or axles which are perpendicular thereto and which cross, respectively, an elongated slot 46 obtained in the frame 1 of the snowshoe and slanted in the vertical direction.

According to the present construction, each elongated slot 46 is slanted upwardly and towards the support piece 43. In this way, when the user applies a weight on the support piece 3, the latter is lowered by pushing back the axes 45 towards the lower part of the elongated slots 46; by this movement of the support piece 3, the elements 45 thus exert a strong pressure on the elongated slots 46 which act as cams, transforming the vertical downward movement of the support piece 3 into a traverse movement of the sides 11, 11' of the frame 1 of the snowshoe forced to bend towards the support piece 43.

Obviously, by inverting the slanting direction of the elongated slots 46, i.e., downwardly and towards the support piece 43, the direction of the transverse movement imposed by the elements 45 to the sides 11, 11' of the frame 1 of the snowshoe is also inverted. In fact, in such a case, the sides 11, 11' are displaced by spacing themselves from the support element 43. In the case of a sloped terrain 26 as shown in FIG. 8, only the elements 45 located on the upward side 15 is lowered simultaneously with the support piece 3, and therefore only the side 11' of the frame 1 of the snowshoe bends.

Any elastic return elements or mechanisms can be associated with the support piece 3, 33, 43, to favor the user stepping forward and/or to automatically reposition the support piece 3, 33, 43 into its original position, ready for the user to put on the snowshoe.

This application is based upon French priority patent application No. 97.07140, filed on Jun. 4, 1997, the disclosure of which is hereby expressly incorporated by reference thereto, and the priority of which is hereby claimed under 35 USC 119.

What is claimed is:

1. A snowshoe comprising:

a frame having oppositely positioned lateral sides, said lateral sides having ground-engaging portions;

a support piece upon which a user's boot is adapted to be supported between said sides of said frame;

means for attaching said support piece to said sides of said frame in suspension and for imposing a force directed downwardly and inwardly on said ground-engaging portions of said frame in response to a downwardly directed force being placed upon said support piece and for causing a lateral inward deflection on each of said lateral sides of said frame.

2. A snowshoe comprising:

a frame having opposite lateral sides, each of said lateral sides having ground-engaging portions;

a support piece upon which a user's boot is adapted to be supported, said support piece having a boot-engaging surface spaced transversely from said sides of said frame;

a connection between said support piece and predetermined locations on said opposite lateral sides of said frame, said connection including attaching elements suspending said support piece relative to said sides to thereby allow a movement of said support piece with respect to said frame from an unweighted position to a lowered weighted position;

said ground-engaging portions on each side of said frame including longitudinally arranged gripping edges for penetrating into the snow, said gripping edges being positioned at least at said predetermined locations on said opposite lateral sides of said frame;

at least said sides of said frame being elastically deformable transversely towards said support piece at least at areas of said connection to said attaching elements.

3. A snowshoe according to claim 2, wherein:

said gripping edges are unitary with said frame.

4. A snowshoe according to claim 2, wherein:

said attaching elements are connected between said support piece and said frame at predetermined points along said sides of said frame.

5. A snowshoe according to claim 2, wherein:

at least said sides of said frame are elastically deformable transversely towards said support piece at least at areas spaced from areas of said connection to said attaching elements.

6. A snowshoe according to claim 2, wherein:

said connection in combination with said sides of said frame comprise means for elastically suspending said support piece from said frame.

7. A snowshoe according to claim 2, further comprising:

means for mounting said support piece for movement around a transverse axis.

8. A snowshoe according to claim 7, wherein:

said support piece includes laterally opposite ends; and said attaching elements are connected between respective ones of said ends of said support piece and said sides of said frame.

9. A snowshoe according to claim 8, wherein:

each of said attaching elements comprises a double-hinged transversely extending member having one hinged connection at said support piece and another hinged connection at a respective side of said frame.

10. A snowshoe according to claim 2, wherein:

said support piece extends transversely relative to said sides of said frame, said support piece including laterally opposite ends; and said attaching elements are constituted by elastic members between respective ones of said ends of said support piece and said sides of said frame.

11. A snowshoe according to claim 2, wherein:

said support piece extends transversely relative to said sides of said frame, said support piece including laterally opposite ends; and said connection includes a flexible strap, said support piece being connected to said flexible strap, said flexible strap having opposite ends connected to respective ones of said sides of said frame.

12. A snowshoe according to claim 2, wherein:

said connection further comprises a transversely extending elongated rod, said support piece being mounted on said rod; and said attaching elements are constituted by assembly axles connected to said rod and extending substantially perpendicular to said rod, said sides of said frame having elongated slots extending at an angle to vertical, said assembly axles being positioned within respective ones of said slots for upward and downward movement therein.

13. A snowshoe according to claim 12, wherein:

said elongated slots extend in a direction upwardly and transversely toward said support piece.

14. A snowshoe according to claim 12, wherein:

said elongated slots extend in a direction downwardly and transversely toward said support piece.

15. A snowshoe according to claim 2, further comprising:

gripping elements are attached to an underside of said support piece for gripping the ground.

16. A snowshoe comprising:

a frame having opposite lateral sides, each of said lateral sides having ground-engaging portions, said ground-engaging portions including lowermost ground-engaging edges;

a support piece upon which a user's boot is adapted to be supported;

a connection between said support piece and predetermined locations on said opposite lateral sides of said frame, said flexible connection including attaching elements suspending said support piece from said sides, to thereby allow a movement of said support piece with respect to said frame from an unweighted position to a lowered weighted position, said support piece having a lower surface positioned, in a stable configuration, above said lowermost ground-engaging edges of said ground-engaging portions of said frame;

said ground-engaging edges extending longitudinally along each side of said frame, at least at said predetermined locations, for penetrating into the snow;

at least said sides of said frame being elastically deformable transversely towards said support piece at least at areas of said connection to said attaching elements.

17. A snowshoe according to claim 16, wherein:

said ground-engaging edges are unitary with the frame.

18. A snowshoe according to claim 16, wherein:

said attaching elements are connected between said support piece and said frame at predetermined points along said sides of said frame.

19. A snowshoe according to claim 16, wherein:

at least said sides of said frame are elastically deformable transversely towards said support piece at least at areas spaced from areas of said connection to said attaching elements.

20. A snowshoe according to claim 16, wherein:

said flexible connection in combination with said sides of said frame comprise means for elastically suspending said support piece from said frame.

21. A snowshoe according to claim 16, further comprising:

means for mounting said support piece for movement around a transverse axis.

22. A snowshoe according to claim 21, wherein:

said support piece includes laterally opposite ends; and said attaching elements are connected between respective ones of said ends of said support piece and said sides of said frame.

23. A snowshoe according to claim 22, wherein:

said support piece extends transversely relative to said sides of said frame, said support piece including laterally opposite ends; and said attaching elements are constituted by elastic members between respective ones of said ends of said support piece and said sides of said frame.

24. A snowshoe according to claim 22, wherein:

each of said attaching elements comprises a double-hinged transversely extending member having one hinged connection at said support piece and another hinged connection at a respective side of said frame.

25. A snowshoe according to claim 16, wherein:

said support piece extends transversely relative to said sides of said frame, said support piece including laterally opposite ends; and said flexible connection includes a flexible strap, said support piece being connected to said flexible strap, said flexible strap having opposite ends connected to respective ones of said sides of said frame.

26. A snowshoe according to claim 16, wherein:

said flexible connection further comprises a transversely extending elongated rod, said support piece being mounted on said rod; and said attaching elements are constituted by assembly axles connected to said rod and extending substantially perpendicular to said rod, said sides of said frame having elongated slots extending at an angle to vertical, said assembly axles being positioned within respective ones of said slots for upward and downward movement therein.

27. A snowshoe according to claim 26, wherein:

said elongated slots extend in a direction upwardly and transversely toward said support piece.

28. A snowshoe according to claim 26, wherein:

said elongated slots extend in a direction downwardly and transversely toward said support piece.

29. A snowshoe according to claim 16, further comprising:

gripping elements are attached to an underside of said support piece for gripping the ground.

* * * * *